US006097922A

United States Patent [19]

Munenaka

[11] Patent Number: 6,097,922

[45] Date of Patent: Aug. 1, 2000

[54] IMAGE FORMING APPARATUS

[75] Inventor: Katsumi Munenaka, Kawasaki, Japan

[73] Assignee: Canon Kabushiki Kaisha, Tokyo, Japan

[21] Appl. No.: 09/132,622

[22] Filed: Aug. 11, 1998

[30] Foreign Application Priority Data

Aug. 14, 1997 [JP] Japan ..... 9-233392
Jul. 30, 1998 [JP] Japan ..... 10-215687

[51] Int. Cl.[7] ..... G03G 15/14; G03G 21/00

[52] U.S. Cl. ..... 399/312; 399/303

[58] Field of Search ..... 399/312, 299, 399/300, 303, 306, 302, 308

[56] References Cited

U.S. PATENT DOCUMENTS

| | | | |
|---|---|---|---|
| 5,602,633 | 2/1997 | Yoshida et al. | 399/244 |
| 5,652,942 | 7/1997 | Iseki et al. | 399/21 |
| 5,678,150 | 10/1997 | Takahashi et al. | 399/299 |
| 5,765,082 | 6/1998 | Numazu et al. | 399/299 |
| 5,794,110 | 8/1998 | Kasai et al. | 399/299 |
| 5,845,188 | 12/1998 | Fujii et al. | 399/390 |
| 5,873,016 | 2/1999 | Kurokawa et al. | 399/297 |

FOREIGN PATENT DOCUMENTS 2-013976 1/1990 Japan .

*Primary Examiner*—Richard Moses
*Attorney, Agent, or Firm*—Fitzpatrick, Cella, Harper & Scinto

[57] ABSTRACT

The present invention provides an image forming apparatus comprises an image bearing member for bearing a toner image, a rotatable transfer material bearing member for bearing a transfer material, a convey means for conveying the transfer material to the transfer material bearing member, the convey means having a transfer material conveying speed faster than a rotational speed of the transfer material bearing member, and an urging means for urging the transfer material against the transfer material bearing member at an urging position, and wherein the toner image on the image bearing member is transferred onto the transfer material at a transfer position where the transfer material is urged against the transfer material bearing member by the urging means and born on the transfer material bearing member, and, when the transfer material is pulled by a force greater than 10 N along a transfer material conveying direction in a condition that the transfer material is urged against the transfer material bearing member by the urging means, the transfer material starts to be slipped with respect to the transfer material bearing member.

35 Claims, 11 Drawing Sheets

IMAGE FORMING APPARATUS

BACKGROUND OF THE INVENTION

1. Field of the Invention

The present invention relates to an electrophotographic image forming apparatus such as an electrophotographic copying machine, an electrophotographic printer and the like.

2. Related Background Art

In conventional image forming apparatuses using an electrophotographic process, there are provided an image forming station at which a latent image is formed by using light, magnetism or charges and at which the latent image is visualized to obtain a visualized image, convey means for conveying a transfer material to the image forming station for permitting the image on the image forming station to be transferred onto the transfer material, and fixing means for fixing the image (transferred to the transfer material) onto the transfer material.

The image forming station includes an image forming medium in the form of an electrophotographic photosensitive body or other bodies having various features and configurations, and there are provided various means such as a latent image forming means and a developing means in association with the image forming medium.

Particularly, in many color image forming apparatuses in which a full-color image is formed by superimposing images on a transfer material by using a plurality of image forming stations, a convey means for absorbing the transfer material onto a surface of a belt and for conveying the transfer material, is used to convey the transfer material from a transfer means for transferring the images onto the transfer material to a fixing means.

A conventional example is disclosed in Applicant's Japanese Patent Laid-Open Application No. 2-13976. An example of such an image forming apparatus will be briefly explained with reference to FIG. 14.

In FIG. 14, the image forming apparatus includes three image forming stations I, II, III. Below image forming stations I, II, III, there is disposed a convey means 139 including a convey belt 126 for conveying a transfer material, and a fixing means 56 having a pair of heat rollers 56*a*, 56*b* for fixing images (on the transfer material) onto the transfer material. The fixing means 56 is disposed at an outlet of the convey means 139. The image forming stations I, II, III include photosensitive drums 111, 112, 113, chargers 114, 115, 116, developing devices 117, 118, 119, transfer chargers 120, 121, 122 and cleaners 123, 124, 125.

The convey belt 126 is formed from resin material, and a surface of the convey belt is charged by an absorb charger 133 to electrostatically absorb the transfer material during the operation so that the transfer material is stably absorbed and conveyed.

Further, while the transfer material 46 fed from a pair of register rollers 49 is being passed through the nip between a driven roller 134 and a press roller 52 (contacted with the driven roller) of the transfer material convey means 139, the transfer material is urged against the charged convey belt 126 so that the transfer material can be electrostatically absorbed onto the convey belt 126 effectively without undulation.

In this case, a conveying speed of the register rollers 49 is selected to be slightly greater than a conveying speed of the convey belt 126 so that by forming a loop in the transfer material between the pair of register rollers 49 and the press roller 52, the conveying speed of the register rollers 49 does not damage the transfer material.

Under high temperature/high humidity environmental conditions, the convey belt 126 may not be charged adequately to float the transfer material. If the transfer material is floating, deviation of transferring, deviation in registration (deviation of image forming position) or/and transfer void will occur. To avoid this, an rotatable auxiliary roller 200 and a rotatable idle roller 203 are provided in a confronting relation.

In this way, in the above-mentioned conventional example, since the auxiliary roller 200 is provided, when the images formed in the image forming stations are transferred onto the transfer material on the convey belt 126, the transfer material does not floating from the convey belt 126 and is surely absorbed onto the convey belt, with the result that a good image can be obtained without deviation of transferring, deviation in registration and transfer void.

On the other hand, if hunting or offset occurs during the movement of the convey belt 126, the deviation in image forming positions on the transfer material due to the presence of the plurality of image forming stations (referred to as "deviation in registration" herein after) is generated, and any known means for correcting hunting and offset is adopted. Among known means for correcting hunting and offset, in general, is a technique in which guide rib(s) are provided at one lateral edge or both lateral edges of the convey belt along its whole length and guide grooves are formed on some of the rollers for driving, holding and tension-applying the convey belt so that the guide ribs are guided by the guide grooves to suppress the hunting and offset.

Other than the above-mentioned conventional image forming apparatus, for example, a color image forming apparatus as shown in FIG. 15 has also widely been used. Such a color image forming apparatus will now be described briefly.

In such an electrophotographic image forming apparatus, a photosensitive drum (image bearing member) 204 is uniformly charged by a first charger (charge roller or corona charger) 214. Then, a first color electrostatic latent image is formed on the image bearing member by exposure 216, effected by an exposure device comprised of a light emitting element 213 such as a laser or an LED, in response to a first color image signal, and the latent image is visualized by a developing device 202*a* containing yellow (Y) developer, for example.

On the other hand, as can be understood by referring to FIG. 16, by using a drum-shaped transfer member 203 formed by covering an outer peripheral surface of a cylindrical conductive drum frame 203*a* by a dielectric flexible sheet 203*b*, bias is applied to the transfer member 203 to electrostatically absorb a supplied transfer material 201 onto the transfer member 203.

The transfer material 201 is supplied one by one by means of a sheet supply roller 214 and is pinched between the transfer member 203 and an absorb roller 215 at a predetermined timing controlled by a pair of register rollers 220. A conveying speed of the pair of register rollers 220 for conveying the transfer material 201 is selected to be slightly greater than a conveying speed of the transfer member 203 for conveying the transfer material 201. At the same time, DC voltage (as transfer bias for absorption and first color transferring) is applied to the drum frame 203*a* from a bias power source 217, and absorb bias is applied to the absorb roller 215 from a bias power source 218. As a result, the transfer material 201 is electrostatically held on the transfer member 203 due to charges from the absorb roller 215.

Then, the transfer material 201 is conveyed, by rotation of the transfer member 203, to a transfer position where the transfer material is opposed to the photosensitive drum 204. Consequently, the visualized image formed on the photosensitive drum 204 is transferred onto the transfer material.

Residual developer remaining on the photosensitive drum 204 is removed by a cleaner 205. Then, the photosensitive drum is uniformly charged by the first charger 214 again and an electrostatic latent image is formed on the photosensitive drum 204 by the exposure device in response to a second color image signal. The electrostatic latent image is developed and visualized by a developing device 202*b* containing magenta (M) developer, for example, corresponding to the second color image signal.

The second color visualized image is transferred by the bias voltage onto the same transfer material (on the transfer member 203) to which the first color visualized image was transferred. The above-mentioned process is repeated by using a third color cyan (C) developer and a fourth color black (BK) developer to form a third color visualized image and a fourth color visualized image on the photosensitive drum 204, successively, which images are in turn transferred onto the transfer material 201 in a superimposed fashion in a manner similar to the second color visualized image.

The transfer material 201 to which the four color visualized images were transferred is conveyed, by the rotation of the transfer member 203, to a separation charger 209 opposed to the peripheral surface of the transfer member 203. At this location the electrostatic absorbing force between the transfer material 201 and the flexible sheet 203*b* is removed by the separation charger 209, with the result that the transfer material is separated by a separation pawl 211 while electricity is being removed from the transfer material 201 by means of a separation and electricity removing charger 210. The separated transfer material 201 is directed, through a transfer material convey path, to a fixing device 206, where the images are fixed to the transfer material by the fixing device 206.

After the transfer material 201 is separated, residual developer remaining on the flexible sheet 203*b*, constituting the outer surface of the transfer member 203, is removed by a transfer member cleaner (not shown) and electricity on the sheet is removed by a sheet electricity removing charger 212 opposed to the sheet 203*b*, thereby initializing the transfer member electrically.

In this way, the visualized images are transferred onto the transfer material 201, thereby forming a color image.

However, in the conventional example shown in FIG. 14, an urging force of the press roller 52 contacted with the driven roller 134 is small. Accordingly, regarding a transfer material having normal thickness, i.e., normal stiffness (flexural rigidity), although the loop can be formed between the pair of register rollers 49 and the press roller 52 in order prevent the pair of register rollers 49 from pulling the transfer material in a direction opposite to a transfer material conveying direction during the transferring, a loop cannot be formed in a stiffer than normal transfer material.

For example, regarding a transfer material such as a thick sheet having a basis weight greater than 200 g/m$^2$, since the stiffness of the transfer material is great, the loop is not formed between the pair of register rollers 49 and the press roller 52, with the result that the transfer material slides with respect to the convey belt 126 at the press roller 52. Consequently, the conveying speed of the transfer material is governed by the conveying speed of the pair of register rollers 49 rather than the conveying speed of the convey belt 126, and, after a tail end of the transfer material leaves the pair of register rollers 49, the conveying speed of the transfer material is governed by the conveying speed of the convey belt 126. That is to say, since the conveying speed of the transfer material passing through the transfer stations is changed, deviation in registration along a sub-scanning direction (deviation of the visualized image from a correct position to which the image is to be transferred), deviation in color or color unevenness occurs, thereby worsening image quality.

Further, the auxiliary roller 200 is also subjected to only a weak urging force sufficient to prevent the transfer material from the convey belt 126. Thus, the urging force of the auxiliary roller 200 generates only a restraining force (for the transfer material) of about 1N, but cannot generate a restraining force sufficient to form a loop in the transfer material having significant stiffness. Accordingly, the deviation in image and deviation in color due to uneven rotation cannot be prevented.

There are the following methods for forming a loop in the transfer material between the pair of register rollers 49 and the convey belt 126 or the press roller 52:

(1) The pair of register rollers 49 are disposed far away from the convey belt 126 or the press roller 52; and (2) An enter angle of the transfer material onto the convey belt 126 given by the pair of register rollers 49 is increased.

However, in the above method (1), the pair of register rollers 49 must be disposed away from the convey belt 126 or the press roller 52 by a distance of 100 to 200 mm, with the result that the entire apparatus is made bulky.

In the above method (2), an angle of several tens of degrees must be established between the conveying direction of the transfer material given by the pair of register rollers 49 and the surface of the convey belt 126, with the result that the degree of freedom of design of an area where transfer materials supplied from a plurality of sheet supply portions such as a manual insertion tray and a sheet supply cassette are joined becomes less.

In any cases, since the apparatus becomes bulky or the layout in the apparatus is limited, the above methods are not so practical.

Further, in the conventional example shown in FIG. 14, although the guide ribs are provided on the lateral edges of the convey belt to prevent hunting and offset of the convey belt during rotation thereof, if the guide ribs themselves are provided in a hunting fashion, when the guide ribs are guided by the grooves or shoulders of the rollers for driving and tension-applying the convey belt, the hunting or staggering of the guide ribs negatively influence the rotation of the convey belt 126. That is to say, when the transfer material passes through the stations, due to the hunting or staggering of the guide ribs, the convey belt 126 is reciprocated in a direction transverse to the advancing direction of the belt, with the result that deviation in registration or deviation in color in a main scanning direction occurs, thereby worsening image quality.

On the other hand, also in the conventional example shown in FIG. 15, means for restraining the transfer material 201 with respect to the transfer member 203 does not exists in the area between the pair of register rollers 220 and the absorb roller 215. Thus, when the transfer material having normal thickness, i.e., normal stiffness (flexural rigidity), although the loop can be formed in the transfer material between the pair of register rollers 220 and the absorb roller 215, a loop cannot be formed in the transfer material having greater stiffness.

For example, regarding the transfer material having base weight greater than 200 g/m$^2$, since the stiffness of the transfer material is great, a loop is not formed between the pair of register rollers 220 and the absorb roller 215, with the result that the transfer material slips with respect to the transfer member 203 at the absorb roller 215. Consequently, if it is expected that the transfer material having the predetermined timing given by the pair of register rollers 220 is absorbed to the predetermined position on the transfer member 203, the tip end of the transfer material advances by an amount corresponding to the slip, with the result that the image to be transferred to the transfer material deviates from the desired position. Alternatively, even after the transfer material is absorbed to the transfer member 203 in a fixed condition, before the absorption of the transfer material to the transfer member 203 is completed, due to the stiffness of the transfer material, the slip may occur at the absorb roller 215.

Accordingly, since the transfer material is absorbed on the transfer member 203 in a partially floating condition, when the image is transferred from the photosensitive drum 204, the image is not transferred onto the partially floating portion of the transfer material, with the result that image void occurs or the distorted image is transferred, thereby generating image deviation or color deviation.

There are the following methods for forming a loop in the transfer material between the pair of register rollers 220 and the absorb roller 215:

(1) The pair of register rollers 220 are disposed far away from the absorb roller 215; and (2) An enter angle of the transfer material onto the transfer member 203 given by the pair of register rollers 220 is increased.

However, in the above method (1), the pair of register rollers 220 must be disposed far away from the absorb roller 215 by a distance of 100 to 200 mm, with the result that the entire apparatus is made bulky.

In the above method (2), when a surface passing through a nip between the transfer member 203 and the absorb roller 215 and contacting with the transfer member 203 is assumed, the conveying direction of the transfer material given by the pair of register rollers 220 must have an enter angle of several tens of degrees with respect to the contact surface, and, this cannot be established easily due to the limitation in the layout regarding the sheet supply cassette, the manual insertion portion and the transfer material convey path.

In any case, since the apparatus becomes bulky or the layout in the apparatus is limited, the above methods are not practical.

SUMMARY OF THE INVENTION

An object of the present invention is to provide an image forming apparatus in which a transfer material adheres to a transfer material bearing member without slip between the transfer material and the transfer material bearing member, thereby preventing image deviation.

The other object and features of the present invention will be apparent from the following detailed explanation of the invention.

DETAILED DESCRIPTION OF THE PREFERRED EMBODIMENTS

Image forming apparatuses according to the present invention will now be fully explained with reference to the accompanying drawings.

First Embodiment

Figure 7:
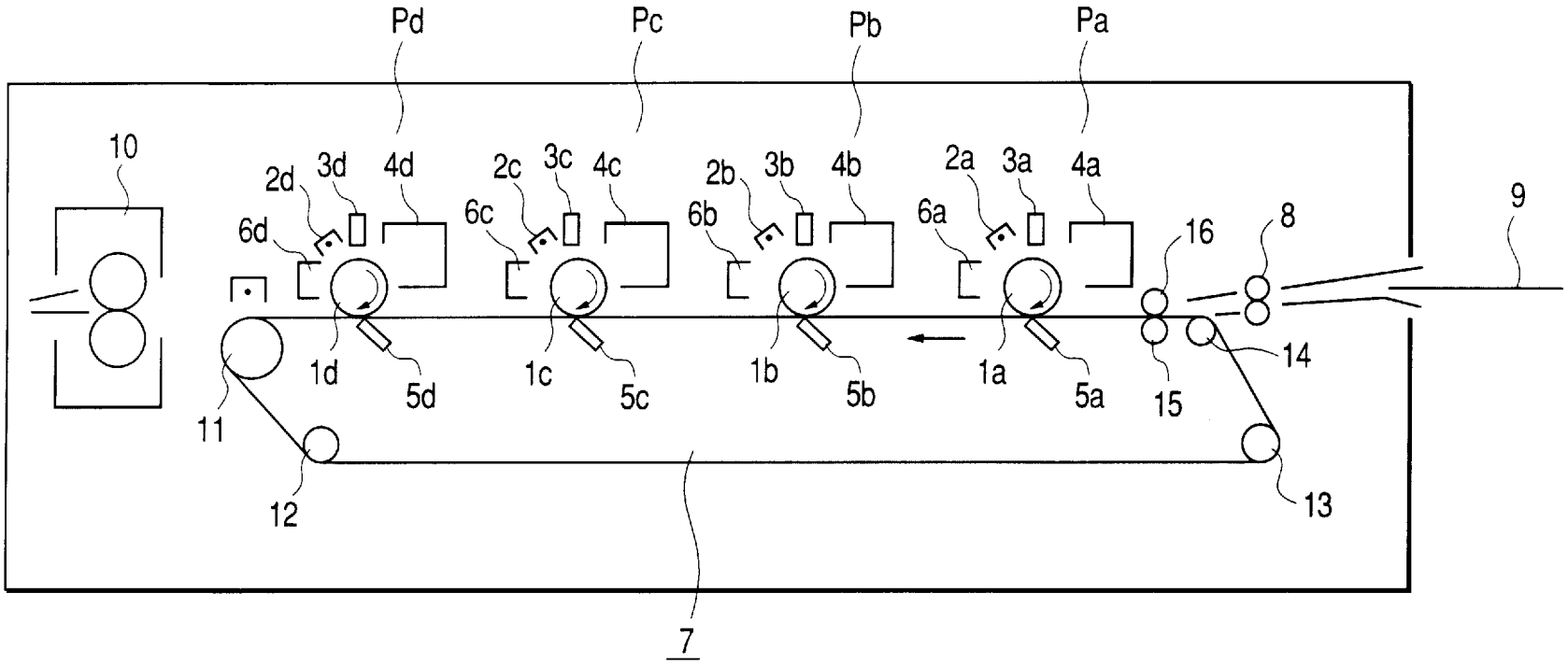
FIG. 7 is a schematic view showing an image forming apparatus according to a first embodiment of the present invention.

FIG. 7 shows a color image forming apparatus according to a first embodiment of the present invention. As shown in FIG. 7, an electrophotographic color copying image forming apparatus comprises four image forming stations Pa, Pb, Pc and Pd including rotatable photosensitive drums (image bearing members) 1*a*, 1*b*, 1*c* and 1*d*, respectively. Around the photosensitive drums 1*a* to 1*d*, along rotational directions thereof, there are disposed chargers 2*a*, 2*b*, 2*c* and 2*d*, exposure devices 3*a*, 3*b*, 3*c* and 3*d*, developing devices 4*a*, 4*b*, 4*c* and 4*d*, transfer chargers 5*a*, 5*b*, 5*c* and 5*d*, and cleaning devices 6*a*, 6*b*, 6*c* and 6*d*, respectively.

On the other hand, below the photosensitive drums 1*a* to 1*d*, a convey belt device 7 including a convey belt (dielectric belt having high resistance) as a transfer material bearing member is disposed to pass through the image forming stations Pa to Pd horizontally. The convey belt device carries a transfer material p supplied from a pair of register rollers 8 disposed at one end of the convey belt device in such a manner that the transfer material passes through transfer nips of the image forming stations Pa to Pd.

In such an electrophotographic color copying apparatus, a color image is formed in the following manner.

That is to say, first of all, after a latent image corresponding to an yellow color component of an original image is formed on the photosensitive drum 1*a* by using the charger 2*a* and the exposure device 3*a* of the image forming station Pa, the latent image is visualized by the developing device 4*a* with yellow toner, and an yellow toner image visualized by the developing device 4*a* is transferred onto the transfer material 9 born and conveyed by the convey belt device 7.

While the yellow toner image is being transferred onto the transfer material 9, as is in the yellow toner image, at the image forming station Pb, a latent image corresponding to a magenta color component of the original image is formed on the photosensitive drum 1*b*, and a magenta toner image is obtained by the developing device 4*b* with magenta toner. When the transfer material 9 to which the yellow toner image was transferred at the first image forming station Pa enters the transfer nip of the second image forming station Pb, the magenta toner image is transferred onto the predetermined position on the transfer material 9 to which the yellow toner image was transferred. Similarly, a cyan toner image and a black toner image are successively formed. After four color toner images were superimposed on the transfer material 9, the transfer material 9 is conveyed to a fixing device 10 disposed at the other end of the convey belt device 7. In the fixing device 10, the toner images are fixed to the transfer material 9, thereby obtaining a multi-color (full-color) image.

On the other hand, after the transferring, residual toners remaining on the photosensitive drums 1*a* to 1*d* are removed by the cleaning devices 6*a* to 6*d*, thereby preparing for next image formation.

Now, the convey belt device 7 for conveying the transfer material used in the above-mentioned color image forming apparatus will be further described with reference to FIGS. 1 to 4.

Figure 1:
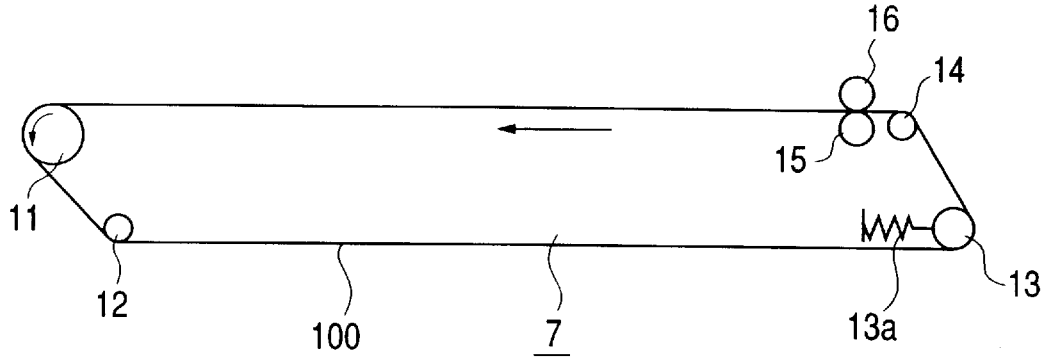
FIG. 1 is an explanatory view showing a convey belt device according to a first embodiment of the present invention.

In FIG. 1, the convey belt (transfer belt) 100 of the convey belt device 7 is mounted around a drive roller 11 and first to third driven rollers 12, 13, 14 and is rotated by driving the drive roller 11.

Among the first to third driven rollers 12 to 14, the first driven roller 12, as well as the drive roller 11, has a position fixed with respect to the convey belt device 7.

The second driven roller 13 also acts as a tension roller for applying predetermined tension to the convey belt 100 via an elastic member 13*a* such as a spring.

The position of the axis of the third driven roller 14 can be adjected along a plane along which the transfer material is conveyed. Thus, the third driven roller acts as an alignment roller. By adjusting the alignment of the third driven roller 14, offset performance of the convey belt 100 in the main scanning direction can be adjusted, so that the convey belt 100 can be set in a substantially neutral condition which can prevent excessive offset.

As shown in FIG. 1, the convey belt device 7 according to the illustrated embodiment has a rotatable fourth driven roller 15 disposed in the vicinity of the third driven roller 14, and a rotatable press roller 16 associated with the roller in pair. In a condition that the convey belt 100 is pinched between the rollers 15 and 16, a total urging force of about 25 to 75 N (Newton) is applied. Further, in the conveying direction of the transfer material, a distance from the fourth driven roller 16 to the transfer nip (transfer position) of the first station is selected to be smaller than a length of the transfer material along its conveying direction.

When the transfer material is borne on the convey belt 100, the press roller 16 is rotated as the transfer material is conveyed. Further, since the press roller 16 functions to urge the transfer material against the convey belt 100, magnitude of coefficient of friction of the surface of the roller 16 dose not cause any problem, and, thus, material selection for roller 16 is less limited.

In the illustrated embodiment, the coefficient of friction between the transfer material and the convey belt 100 is about 0.4, and, since the transfer material and the convey belt 100 are pinched by the urging force of 25 to 75 Newtons, when the transfer material tries to slip in a transfer material conveying plane constituted by the convey belt 100, a force of 10 Newtons (=25 N×0.4) at the minimum and 30 Newtons (=75 N×0.4) at the maximum is required.

Further, a force required for slipping the transfer material with respect to the convey belt 100 can be measured by the following method.

In a condition that the convey belt 100 is stopped and the transfer material is urged against the convey belt 100 by the press roller 16, the transfer material is pulled toward the conveying direction of the transfer material, and a pulling force obtained when the transfer material starts to slip with respect to the convey belt 100 is measured. The pulling force may be measured by reading a value (obtained when the transfer material starts to slip) of a tension gauge attached to the tip end of the transfer material.

As the transfer material to be measured, a thick sheet used with a color laser copier (manufactured by Canon Inc.) and having base weight of 209 g/m$^2$ was used.

Figure 2:
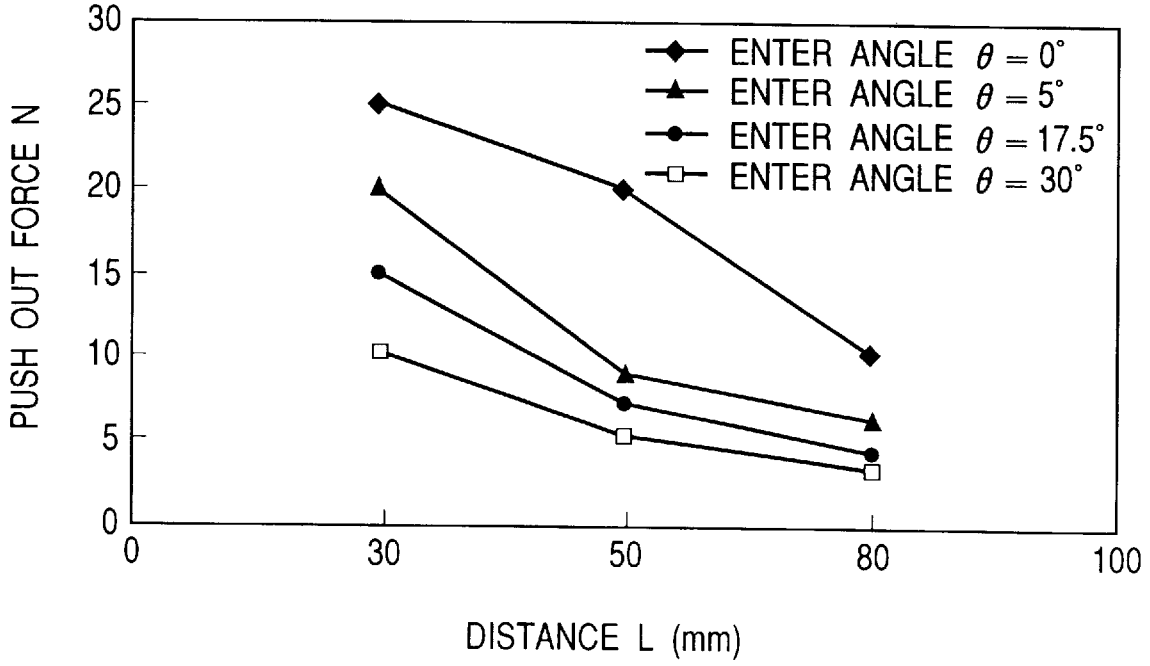
FIG. 2 is a graph showing measured results regarding a push out force in association with stiffness of a sheet.
Figure 3:
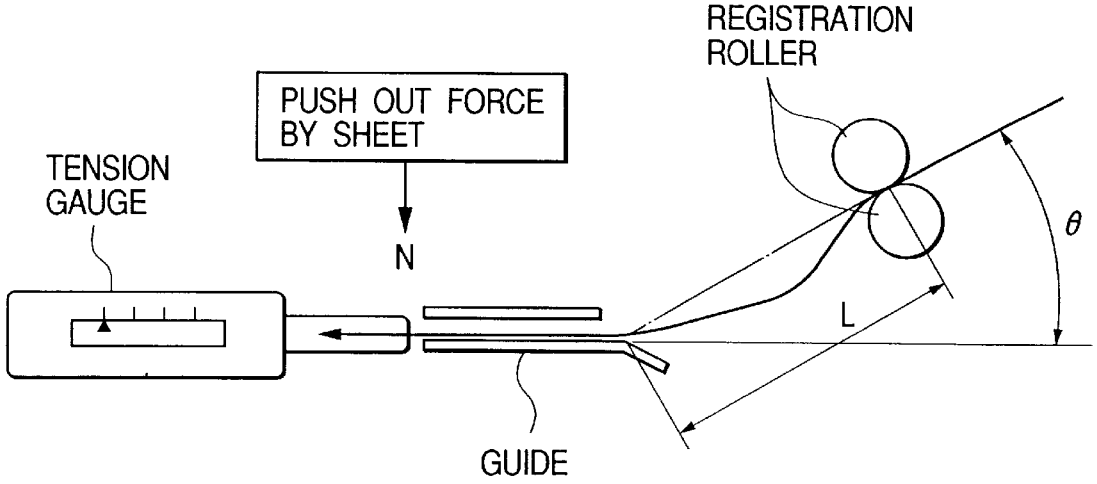
FIG. 3 is an explanatory view showing a device for obtaining the measured results in FIG. 2.

FIG. 2 is a graph showing test results in which A3 size paper sheets having a base weight of 209 g/m$^2$ were selected as the thick sheets and push out forces by the paper sheets were measured (an enter angle θ and a distance L from the pair of regist rollers to a position where the sheet firstly abuts against the guide were used as factors), and FIG. 3 shows a device used in such tests. In this example, the push out force N by the paper sheet was measured by the tension gauge.

When the push out force becomes relatively small within a range in which both the enter angle θ and the distance L are small is sought, it was found that the push out force becomes about 10 N or less when θ equals to 5° and L equals to 50 mm.

That is to say, according to the test data shown in FIG. 2, when the distance is about 30 mm, it is relatively hard to form a loop in the transfer material, and the push out force N corresponds to the magnitude of the enter angle θ substantially linearly. On the other hand, it can be seen that, when the distance L is about 50 mm, if θ is not equal to 0, i.e., so long as there is a chance for forming the loop, the push out force N becomes small in comparison with the case L equals to 30 mm. Furthermore, the distance L is selected to about 80 mm, the push out force N cannot be significantly reduced. Thus, it was considered that the case where distance L equals to 50 mm and enter angle θ equals to 5° are reasonable, and the push out force N of 10 N at such a condition was selected.

The reason that the force required when the transfer material tries to slip in the transfer material conveying plane of the convey belt is selected to be at least 10 N is based on the above test data.

As shown in FIG. 7, an arrangement in which the pair of register rollers 8 are disposed in the vicinity of the convey belt device 7 (more particularly, in the vicinity of the first image forming station Pa) and the enter angle of the transfer material onto the transfer material conveying plane of the convey belt is relatively small (enter angle θ nearly equals to 5°) to provide a relatively straight path is adopted.

Further, according the test data shown in FIG. 2, regarding the paper sheet having the base weight of 209 g/m$^2$ and having A3 size, it is known that, when the distance L equals to 30 mm and the enter angle θ equals to 0°, the push out force by the paper sheet becomes about 25 Newtons.

Very rarely, under certain circumstances, a transfer material having strong stiffness (having base weight exceeding 209 g/m$^2$) may be used.

However, if the pinching force between the press roller 16 and the fourth driven roller 15 is increased, the following disadvantages will occur:

1. deterioration of endurance of the convey belt 100;
2. increase in drive load for the convey belt 100; and
3. deterioration of image quality caused by fluctuation in drive load for the convey belt 100 when the tip end of the transfer material enters into the press roller 16 or the tail end of the transfer material leaves the press roller 16.

In consideration of the above, it is preferable that the force required when the transfer material slips in the transfer material conveying plane of the convey belt is selected to 30 N or less.

As mentioned above, the conveying speed of the pair of register rollers 8 for conveying the transfer material is selected to be slightly greater than the speed of the convey belt 100. Even when a significantly stiff transfer material such as a thick sheet is conveyed, due to the action of the press roller 16, the transfer material is conveyed together with the convey belt 100 without generating slip between the transfer material and the convey belt 100 while surely forming a loop in the transfer material between the press roller and the pair of register rollers 8.

Further, the pinching force of the pair of register rollers 8 for pinching the transfer material, i.e., the force for urging the transfer material, is made stronger. With this arrangement, the loop formed in the transfer material between the pair of register rollers 8 and the press roller 16 cannot be eliminated toward the upstream side in the transfer material conveying direction.

That is to say, in the condition that the transfer material is urged by the press roller 16, the force required for the transfer material to slip is equal to or smaller than the force required for pulling the transfer material in the condition that the transfer material is urged and pinched by the pair of regist rollers 8.

Further, the pair of register rollers 8 and a pair of convey rollers (for conveying the transfer material) disposed at an upstream side of the pair of register rollers 8 in the transfer material conveying direction are always urged against with each other so that the conveying force for conveying the transfer material continues to be provided while the transfer material passes through these rollers.

Figure 4:
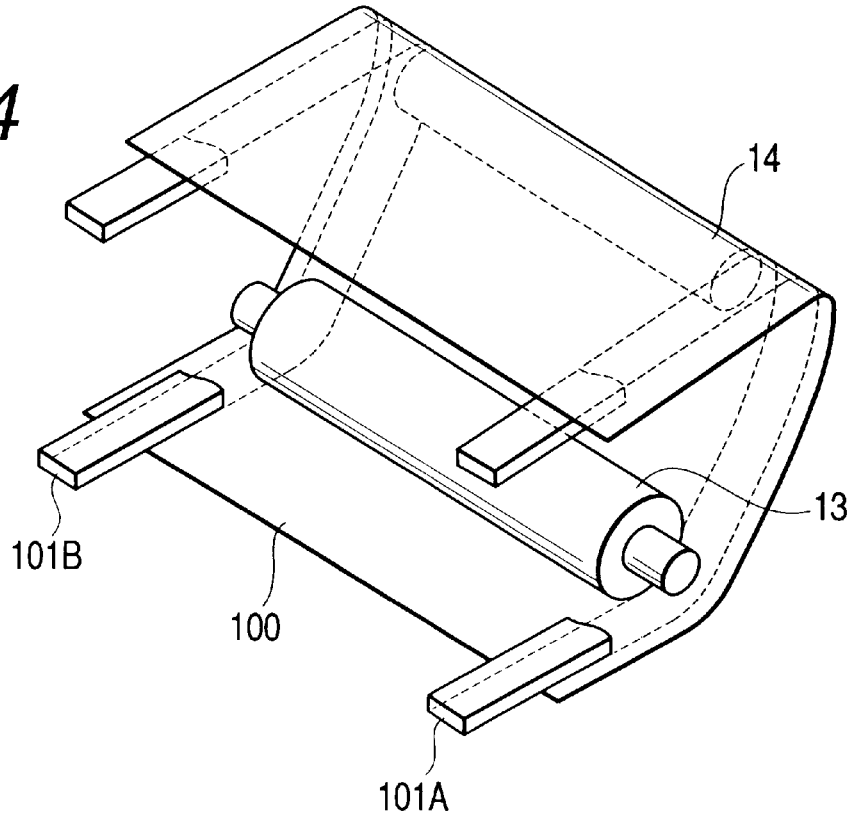
FIG. 4 is a perspective view showing a main portion of the convey belt device.

Further, as shown in FIG. 4, guide ribs 101A, 101B are bonded to the inner peripheral surface portions of both ends (in a direction transverse to the advancing direction of the convey belt 100) of the convey belt in areas outside of where the transferring is not effected (i.e., at areas on which the transfer material is not borne), so that offset and hunting of the convey belt 100 are regulated by the cooperation of the guide ribs and both shoulders of the second driven roller 13, also acting as the tension roller.

Since the ends of the guide ribs 101A, 101B are regulated by the shoulders of the driven roller 13, although it is desirable that the ribs have good straight feature as much as possible, actually, ribs may have undulation or steps.

Figure 5:
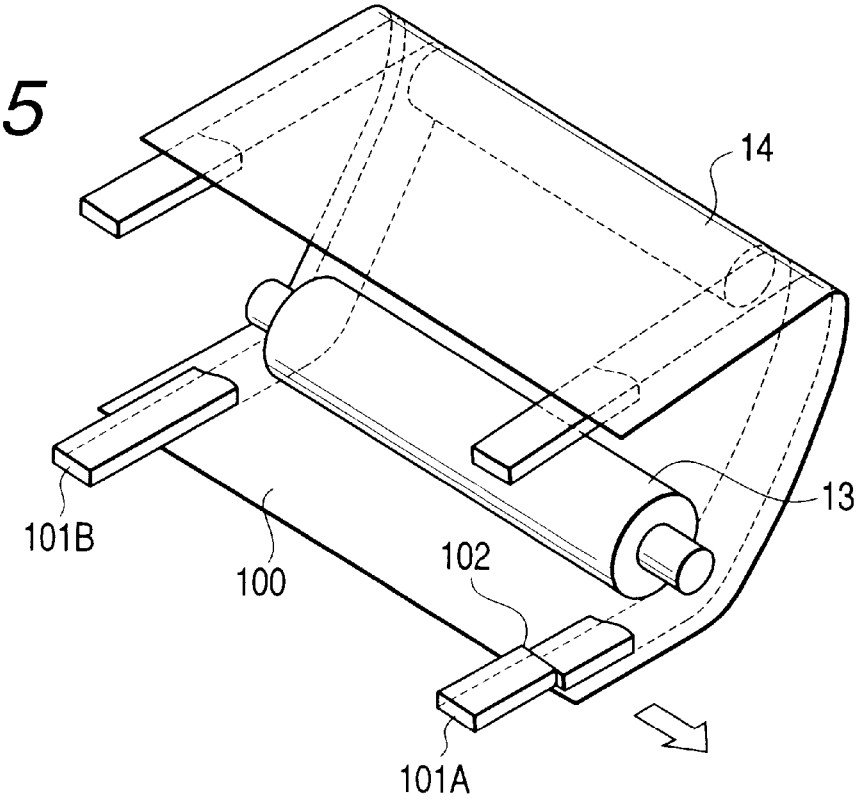
FIG. 5 is a perspective view showing a main portion of FIG. 4 in an emphasizing manner.

For easy understanding, explaining an extreme example, as shown in FIG. 5, in a condition that the guide ribs are regulated, if the guide rib 101A has a step 102, at the time when the step 102 abuts against the shoulder of the driven roller 13, the convey belt 100 starts to be deviated toward a direction shown by the arrow. However, at the downstream side of the press roller 16, i.e., at the image transfer position, the convey roller 100 is not deviated in the main scanning direction immediately by the action of the press roller 16, but, the convey belt is deviated slowly, and, the deviation amount can be reduced to about a half the deviation amount when the press roller 16 is not provided.

Figure 6A:
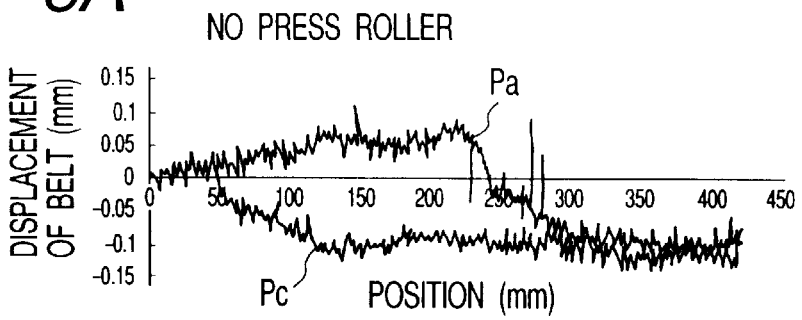
FIGS. 6A, 6B, 6C and 6D are graphs showing test results regarding displacement of a convey belt in a main scanning direction and results regarding simulation of color gap (deviation) amounts.
Figure 6B:
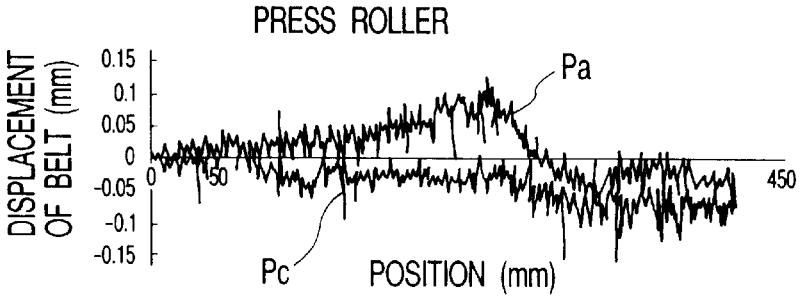

FIGS. 6A and 6B show results for A3 size transfer material in which the excessive step 102 was intentionally provided and the movement of the convey belt 100 in the main scanning direction was observed at the transfer positions of the first and third image forming stations Pa, Pc. In graphs shown in FIGS. 6A and 6B, the abscissa indicates a position (mm) from the tip end of the transfer material having A3 size and the ordinate indicates displacement (mm) of the convey belt from the normal position in the main scanning direction.

Figure 6C:
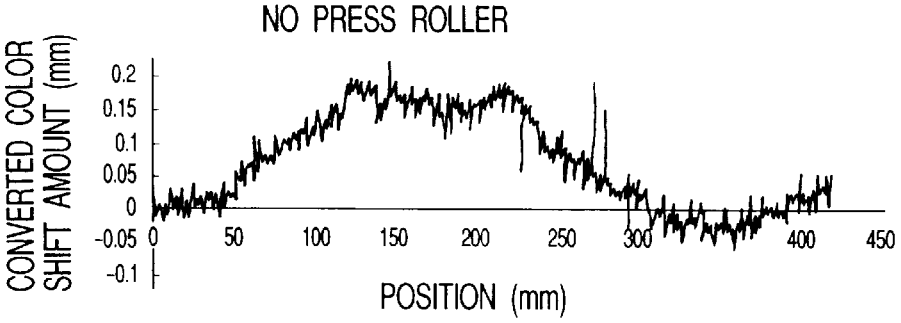
Figure 6D:
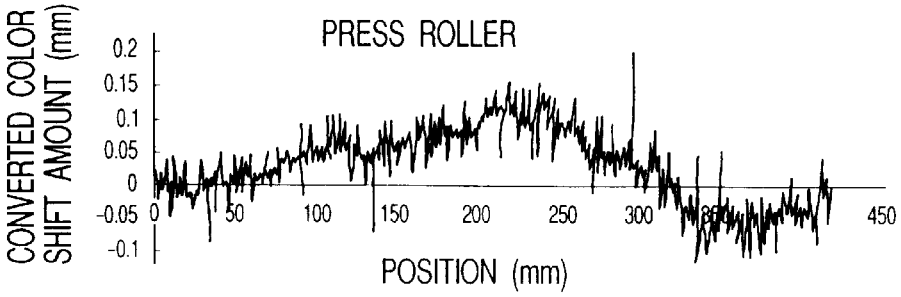

FIGS. 6C and 6D show simulation of color deviation (gap) amounts at the two image forming stations based on the observing data. In graphs shown in FIGS. 6C and 6D, the abscissa indicates a position (mm) from the tip end of the transfer material having A3 size and the ordinate indicates the color deviation amount in the main scanning direction.

It was ascertained that the simulation result coincides with the actual color deviation amount in the image start.

Among the above graphs, upper graphs (FIGS. 6A and 6C) show the case where the press roller 16 is not provided, and lower graphs (FIGS. 6B and 6D) show the case where the press roller 16 is provided.

The influence of the step 102 of the guide rib appears at a position of about 230 mm with respect to the first image forming station and a position of about 40 mm with respect to the third image forming station.

In the illustrated embodiment, since the transfer material is electrostatically absorbed to the convey belt 100 at the same time as when the toner image is transferred at the transfer nip of the first image forming station, the urging of the transfer material against the convey belt 100 by the press roller 16 as mentioned above is effective.

Accordingly, since an additional charger for electrostatically absorbing the transfer material to the convey belt 100 is not required, the entire apparatus can be made less expensively and the installation space can be saved.

Second Embodiment

Figure 8:
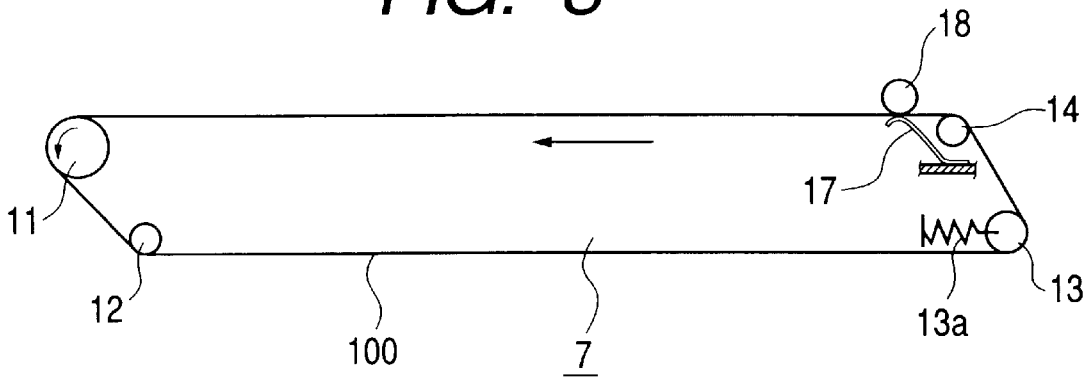
FIG. 8 is a schematic view showing an image forming apparatus according to a second embodiment of the present invention.

FIG. 8 shows a convey belt device according to a second embodiment of the present invention. The convey belt device 7 according to the second embodiment has a construction similar to that in the first embodiment and is characterized in that there is provided a press roller 18 associated with a leaf spring 17.

The leaf spring 17 is disposed inside of the convey belt 100 and has one end secured to a frame of the convey belt device 7 and the other end cooperating with the press roller 18 to pinch the convey belt 100 therebetween.

The press roller 18 and the leaf spring 17 are subjected to a total urging force of 25 to 75 N in when the convey belt 100 is pinched therebetween, and the press roller 18 can be rotated by rotation of the convey belt 100 (transfer material) and the leaf spring 17 is slidably contacted with the convey belt 100.

The press roller 18 is the same as the press roller 16 in the first embodiment, and, thus, since the press roller serves to urge the transfer material against the convey belt 100, the magnitude of coefficient of friction of the surface of the roller 18 does not cause a problem, and, thus, a broader variety of materials for the roller 18 may be used.

In the illustrated embodiment, the coefficient of friction between the transfer material and the convey belt 100 is about 0.4, and, since the transfer material and the convey belt 100 are pinched by the urging force of 25 to 75 N, when the transfer material starts slipping in a transfer material conveying plane constituted by the convey belt 100 by applying a force to the transfer material, a force of 10 Newtons (=25 N×0.4) at the minimum and 30 Newtons (=75 N×0.4) at the maximum is required.

In the first embodiment, since the press roller 16 is associated with the fourth driven roller 15, the drive load for the convey belt 100 was very small. However, in the second embodiment, since the press roller 18 is associated with the leaf spring 17, there is sliding resistance between the leaf spring and the inner peripheral surface of the convey belt 100. Thus, in the illustrated embodiment, as is in the first embodiment, it is preferable that the maximum value is 30 N or less.

In the first and second embodiments, even when a very stiff transfer material great stiffness due such as a thick sheet is conveyed, the action of the press roller 18 allows the transfer material to be conveyed together with the convey belt 100 without slip between the transfer material and the convey belt 100 while forming the loop with certainty in the transfer material between the press roller and the pair of regist rollers 8.

Further, regarding the regulation of the movement of the convey belt 100 in the main scanning direction, the result substantially the same as the first embodiment could be obtained.

Third Embodiment

Figure 9:
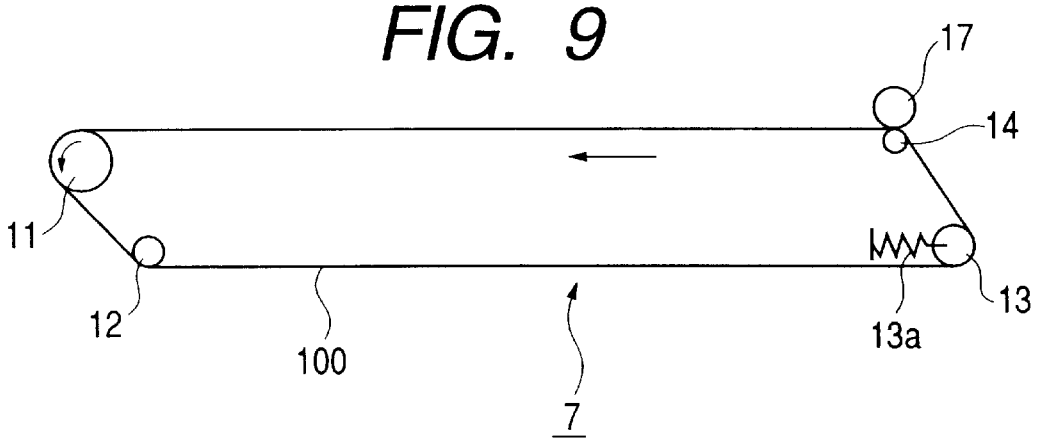
FIG. 9 is an explanatory view showing a convey belt device according to a third embodiment of the present invention.

FIG. 9 shows a convey belt device according to a third embodiment of the present invention. The convey belt device 7 according to the third embodiment has a construction similar to that in the first embodiment and is characterized in that there is provided a press roller 17 opposed to the third driven roller 14.

The third driven roller 14 is constructed so that parallelism of an axis of the roller can be adjusted with respect to the drive roller 11 in the transfer material conveying plane and, thus, driven roller 14 acts as an alignment roller. By adjusting the alignment of the third driven roller 14, offset performance of the convey belt 100 in the main scanning direction can be adjusted, so that the convey belt 100 can be set in a substantially neutral condition which can prevent excessive offset.

The press roller 17 is associated with the driven roller 14 to adjust the alignment. The press roller 17 and the driven roller 14 are subjected to a total urging force of about 25 N in a condition that the convey belt 100 is pinched therebetween. These rollers are rotatable.

The press roller 17 is the same as the press roller 16 in the first embodiment, and, since the press roller 17 serves to urge the transfer material against the convey belt 100, the magnitude of coefficient of friction of the surface of the roller 17 does not cause a problem, and, thus, a larger variety of materials of the roller 17 is available.

In the illustrated embodiment, the coefficient of friction between the transfer material and the convey belt 100 is about 0.4, and, since the transfer material and the convey belt 100 are pinched by the urging force of 25 to 75 N, when the transfer material tries to slip in a transfer material conveying plane constituted by the convey belt 100 by applying a force to the transfer material, a force of 10 N (=25 N×0.4) at the minimum and 30 N (=75 N×0.4) at the maximum is required.

As is in the first embodiment, there is adapted an arrangement in which the pair of register rollers 8 are disposed in the vicinity of the convey belt device 7 (more particularly, in the vicinity of the first image forming station Pa) and the enter angle of the transfer material onto the transfer plane is relatively small to provide a relatively straight path.

Even when a very stiff transfer material having such as a thick sheet is conveyed, due to the action of the press roller 17, the transfer material is conveyed together with the convey belt 100 without generating the slip between the transfer material and the convey belt 100 while surely forming a loop in the transfer material between the press roller and the pair of register rollers 8.

Further, since the regulation of the movement of the convey belt 100 in the main scanning direction is substantially the same as the first embodiment, explanation thereof will be omitted.

Fourth Embodiment

Figure 10:
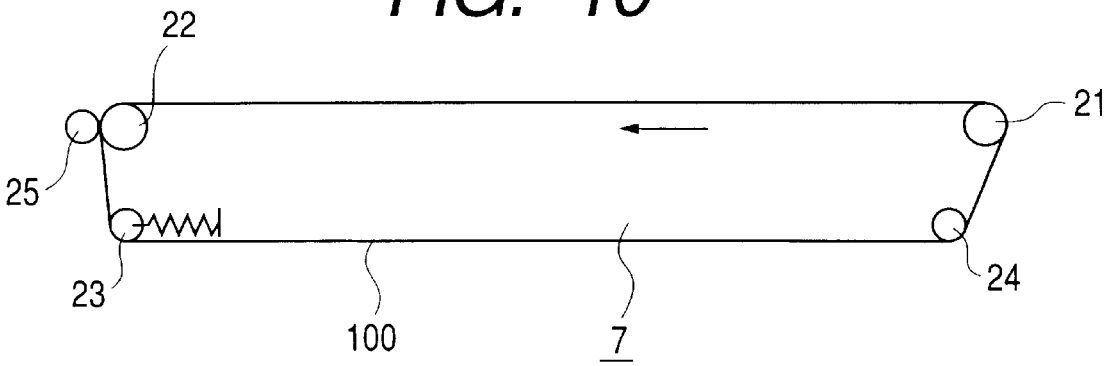
FIG. 10 is an explanatory view showing a convey belt device according to a fourth embodiment of the present invention.

FIG. 10 shows a convey belt device according to a fourth embodiment of the present invention. The convey belt 100 of the convey belt device 7 is wound around a drive roller 21 and first to third driven rollers 22, 23, 24 which are disposed at an upstream side in the transfer material conveying direction, and the convey belt 100 is rotated by driving the drive roller 21.

The third driven roller 24, as well as the drive roller 21, are each fixed in position with respect to the convey belt device 7. The second driven roller 23 also acts as a tension roller for applying predetermined tension to the convey belt 100.

Parallelism of an axis of the first driven roller 22 with respect to the drive roller 21 can be adjusted in a plane along which the transfer material is conveyed. Thus, the first driven roller acts as an alignment roller. By adjusting the alignment of the first driven roller 22, offset performance of the convey belt 100 in the main scanning direction can be adjusted, so that the convey belt 100 can be set in a substantially neutral condition which can prevent excessive offset.

A press roller 25 cooperates with the first driven roller 22 in pair to permit the alignment adjustment.

The press roller 25 and the first driven roller 22 are rotatable and are subjected to a force when the convey belt 100 is pinched therebetween.

As is in the first embodiment, the second driven roller 23 serves to regulate the guide ribs provided on the convey belt 100, thereby regulating the offset and hunting of the convey belt 100. If the straight feature of the guide ribs has a problem, since the movement of the convey belt 100 in the main scanning direction is restrained, the offset and hunting can be prevented.

Thus, deviation of the convey belt 100 in the main scanning direction can be suppressed to the minimum at the image transfer positions.

Fifth Embodiment

Next, a fifth embodiment of the present invention will be explained with reference to FIG. 11. An intermediate transfer belt 301 according to the fifth embodiment corresponds to the convey belt 100 of the first embodiment.

Figure 11:
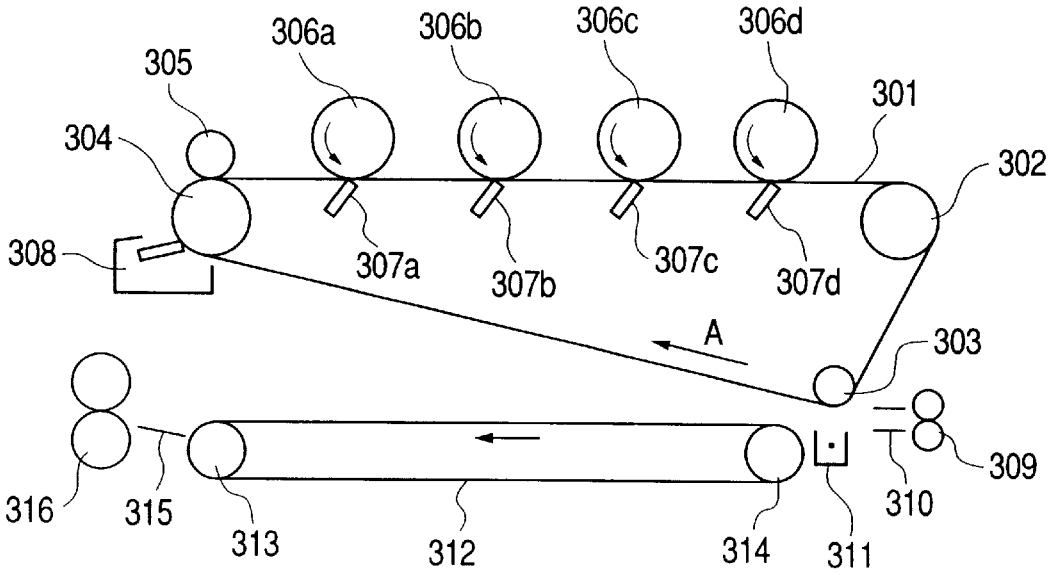
FIG. 11 is a schematic view showing an image forming apparatus having an intermediate transfer belt, according to a fifth embodiment of the present invention.

In FIG. 11, the intermediate transfer belt 301 are mounted around a drive roller 302 and driven rollers 303, 304 in a tension condition and is rotated in a direction shown by the arrow A. Four photosensitive drums 306*a*, 306*b*, 306*c* and 306*d* are disposed side by side with a predetermined interval above an upper horizontal run of the intermediate transfer belt 301, and four transfer electrodes 307*a*, 307*b*, 307*c* and 307*d* are urged against the photosensitive drums with the interposition of the intermediate transfer belt 301. Since process means disposed around the photosensitive drums are the same as those in the first embodiment, these process means are omitted from illustration.

The driven roller 304 is urged by a press roller 305 with the interposition of the intermediate transfer belt 301 and is rotatingly driven. The press roller 305 corresponds to the press roller 16 of the first embodiment.

While the intermediate transfer belt 301 is being rotated by the drive roller 302 in the direction A, color toner images formed on the photosensitive drums 306*a* to 306*d* are successively transferred onto the surface of the intermediate transfer belt in a superimposed fashion.

A pair of register rollers 309 are disposed in the vicinity of the driven roller 303, and a transfer material supplied from a sheet supply cassette (not shown) is sent, at a predetermined speed, to a transfer position between the driven roller 303 and a transfer corotron 311 through a guide 310 at a predetermined timing controlled by the pair of register rollers 309.

The color toner images superimposed on the intermediate transfer belt 301 are collectively transferred onto the transfer material at the transfer position. The transfer material is conveyed by a transfer material convey belt 312 mounted around a drive roller 313 and a driven roller 314 in a tension condition and is sent to a pair of fixing rollers 316 while being guided by a guide 315. The color toner images transferred to the transfer material are heated and pressurized by the pair of fixing rollers 316 to be fixed as a full-color image.

After the transferring, residual toner remaining on the intermediate transfer belt 301 is scraped by a cleaner 308 disposed adjacent to the driven roller 304, thereby preparing for next image formation.

In the illustrated embodiment, by providing the rotating press roller 305 urged against the intermediate transfer belt at the upstream side of the transfer position (of the intermediate transfer belt) where the images are borne temporarily, even if a disturbance leading to fluctuation of position of the intermediate transfer belt in the main scanning direction is generated during the running of the intermediate transfer belt, since the deviation of the intermediate transfer belt in the main scanning direction is regulated by the press roller, a good image having less color deviation and less color unevenness can be obtained.

Sixth Embodiment

Next, a sixth embodiment of the present invention will be explained with reference to FIG. 12. In this sixth embodiment, a photosensitive belt 401 corresponds to the convey belt 100 in the first embodiment.

Figure 12:
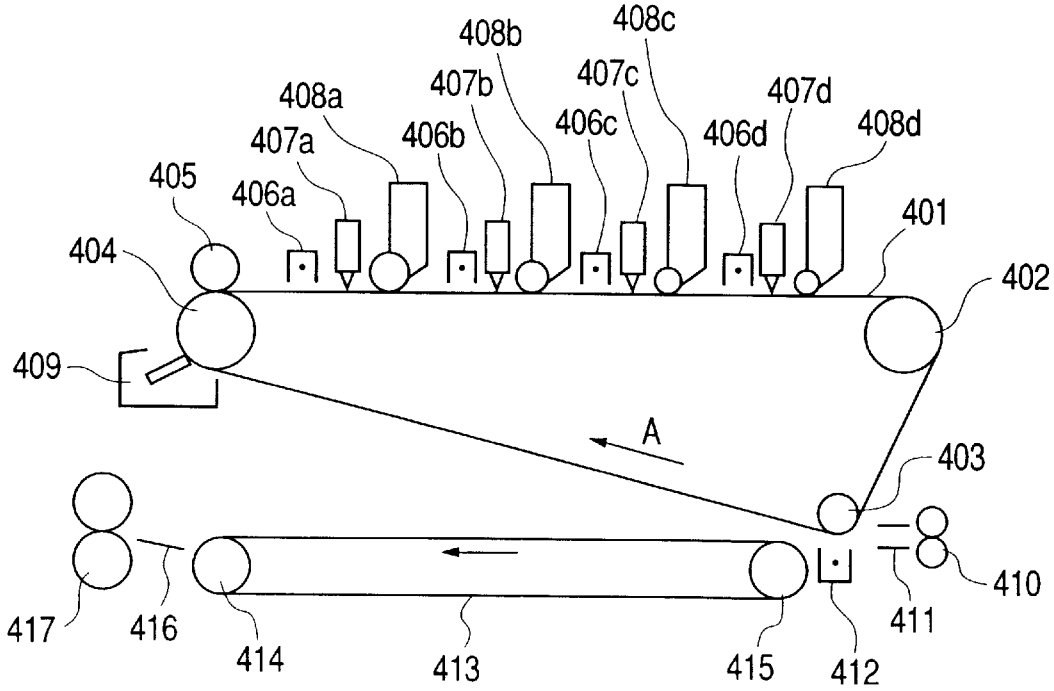
FIG. 12 is a schematic view showing an image forming apparatus having a photosensitive belt, according to a sixth embodiment of the present invention.

In FIG. 12, the photosensitive belt 401 is mounted around a drive roller 402 and driven rollers 403, 404 in a tension condition and is moved in a direction shown by the arrow A.

Above a horizontal portion of the photosensitive belt 401, there is disposed a first station including a corotron 406*a* for giving a uniform charges to a surface of the photosensitive belt 401, an LED array 407*a* for forming an electrostatic latent image on the photosensitive belt 401 and a developing device 408*a* for visualizing the electrostatic latent image with toner. Similarly, second to fourth stations are disposed side by side (b to d).

While the photosensitive belt 401 is being rotated by the drive roller 402 in the direction A, color toner images are successively superimposed on the surface of the photosensitive belt.

A pair of register rollers 410 are disposed in the vicinity of the driven roller 403, and a transfer material supplied from a sheet supply cassette (not shown) is sent, at a predetermined speed, to a transfer position between the driven roller 403 and a transfer corotron 412 through a guide plate 411 at a predetermined timing controlled by the pair of register rollers 410.

The color toner images superimposed on the photosensitive belt 401 are collectively transferred onto the transfer material at the transfer position. The transfer material is conveyed by a transfer material convey belt 413 mounted around a drive roller 414 and a driven roller 415 in a tension condition and is sent to a pair of fixing rollers 417 while being guided by a guide 416.

The color toner images transferred to the transfer material are heated and pressurized by the pair of fixing rollers 417 to be fixed as a full-color image.

After the transferring, residual toner remaining on the photosensitive belt 401 is scraped by a cleaner 409 disposed adjacent to the driven roller 404, thereby preparing for next Image formation.

In the illustrated embodiment, by providing a rotating press roller 405 urged against the photosensitive belt at an upstream side of a position (of the photosensitive belt) where the image is formed, even if disturbance leading to fluctuation of position of the photosensitive belt in the main scanning direction is generated during the running of the photosensitive belt, since the deviation of the photosensitive belt in the main scanning direction is regulated by the press roller 405, a good image having less color deviation and less color unevenness can be obtained.

Seventh Embodiment

Figure 13:
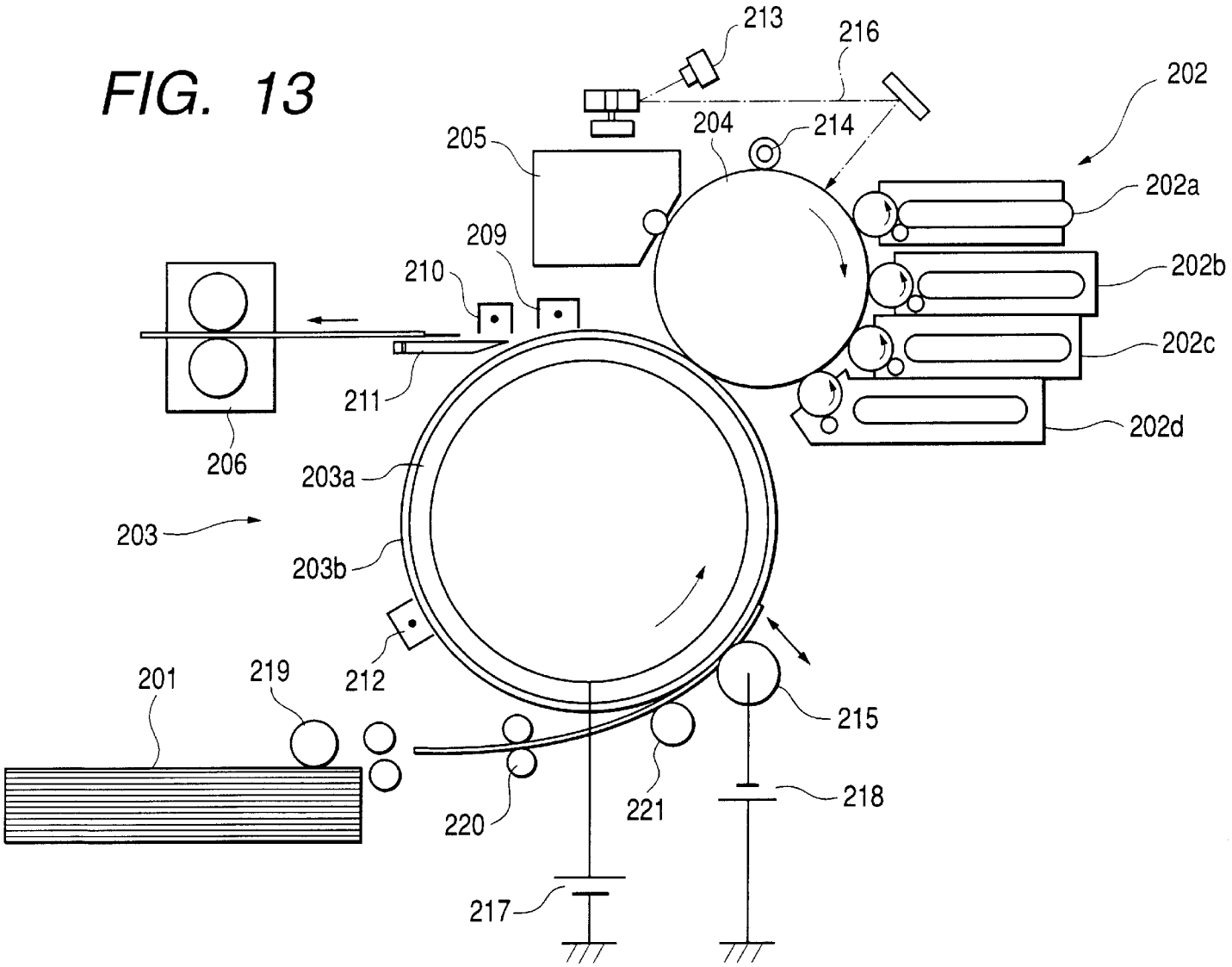
FIG. 13 is a schematic view showing an image forming apparatus according to a seventh embodiment of the present invention.
Figure 14:
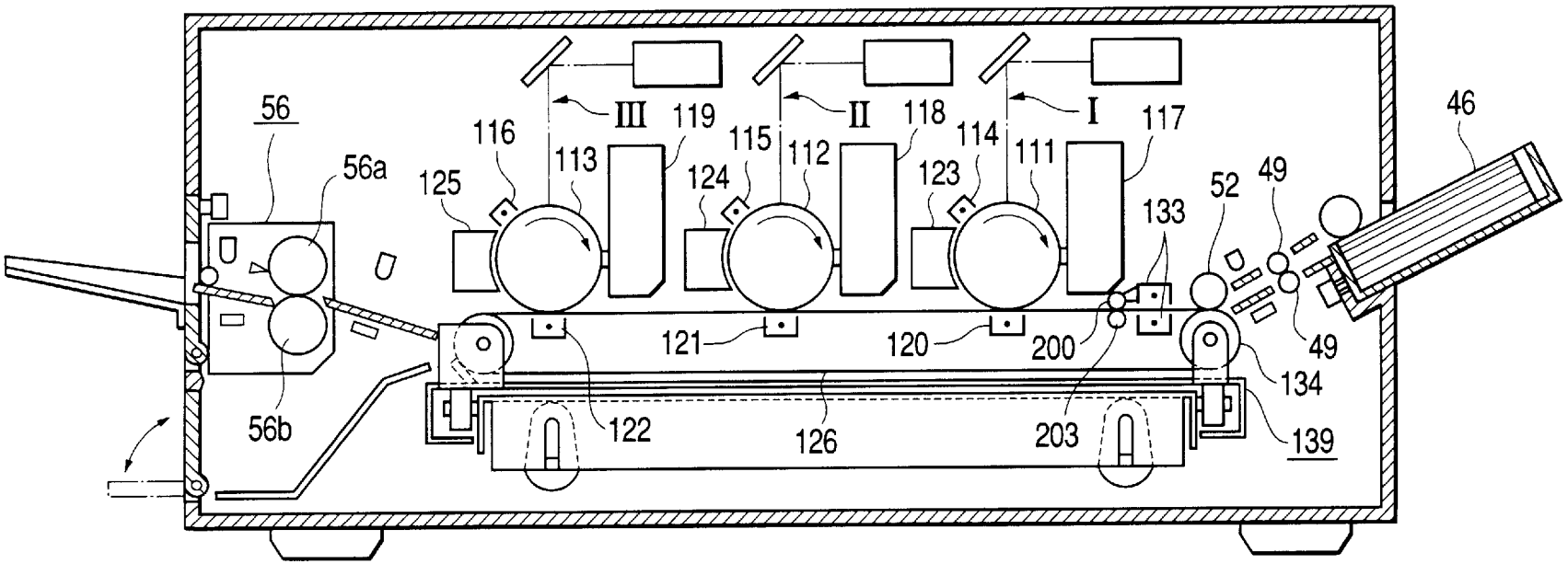
FIG. 14 is an explanatory view showing an example of a conventional image forming apparatus.
Figure 15:
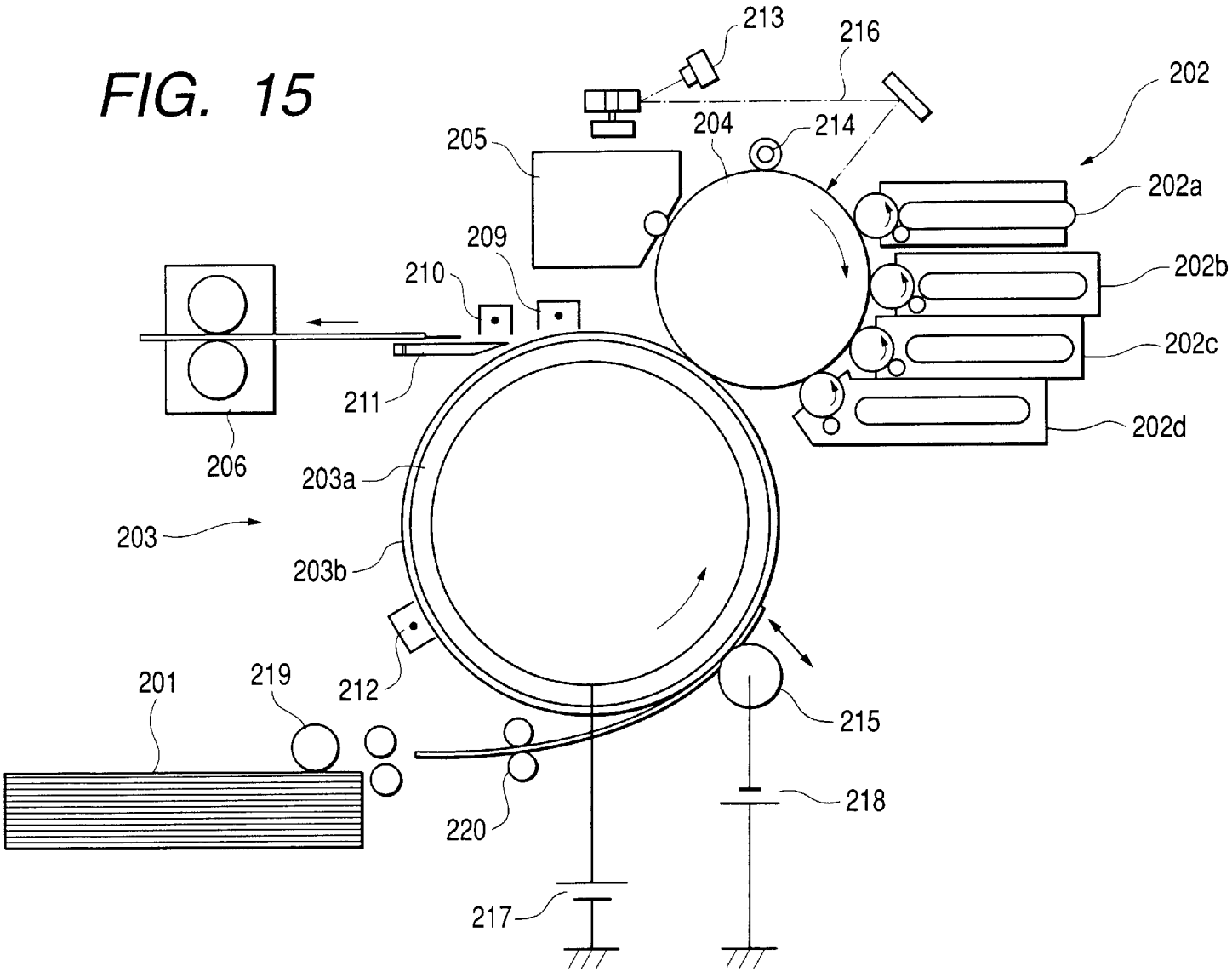
FIG. 15 is an explanatory view showing another conventional example.
Figure 16:
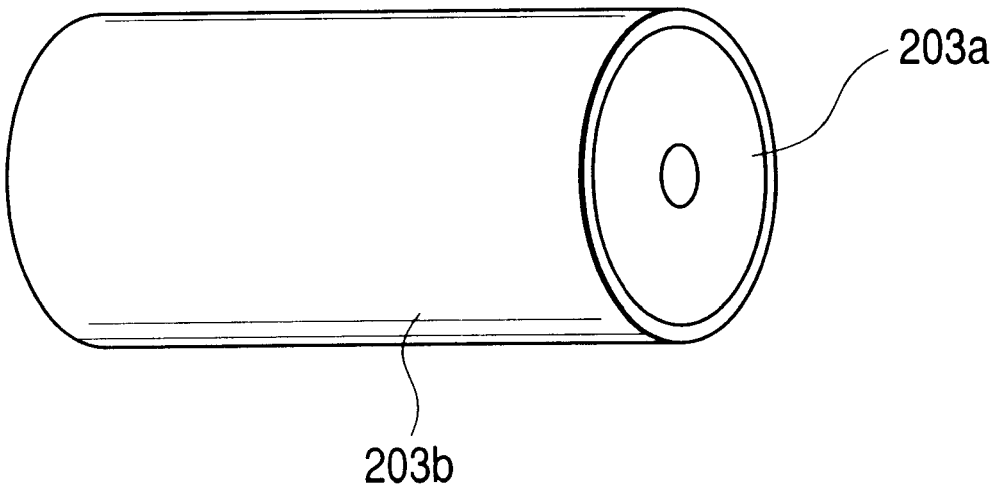
FIG. 16 is a perspective view showing a main portion of other conventional example.

FIG. 13 is a schematic sectional view of a color image forming apparatus (to which the present invention is applied) in which visualized images on a photosensitive drum are successively transferred onto a transfer material borne on a rotatable transfer member to obtain a color image. Since construction of the apparatus is substantially the same as that of the conventional apparatus explained in connection with FIGS. 15 and 16, explanation thereof will be omitted.

A press roller 221 is urged against a surface of the transfer member 203 with a force of 25 to 75 N and is rotated by rotation of the transfer member 203.

In the illustrated embodiment, the coefficient of friction between a transfer material and a flexible sheet 203*b* is about 0.4, and, since the transfer material and the flexible sheet 203*b* are pinched by an urging force of 25 to 75 N, when the transfer material starts slipping in a transfer material conveying plane constituted by the flexible sheet 203*b* by applying a force to the transfer material, a force of 10 Newtons (=25 N×0.4) at the minimum and 30 N (=75 N×0.4) at the maximum is required.

The transfer material fed from a pair of register rollers 220 at a predetermined timing is firstly urged against the transfer member 203 by the press roller 221 and then is directed to an absorb roller 215 together with the flexible sheet 203*b* without slipping with respect to the flexible sheet, with the result that the entire transfer material is closely absorbed onto the transfer member 203. Accordingly, even when a very stiff material is urged, the transfer material can be absorbed to a desired position on the transfer member 203, thereby preventing image deviation.

The above-mentioned embodiments may be combined appropriately.

What is claimed is:

1. An image forming apparatus comprising:

an image bearing member for bearing a toner image;

a movable transfer material bearing member for bearing a transfer material;

a convey means for conveying the transfer material to said transfer material bearing member, said convey means having a transfer material conveying speed faster than a moving speed of said transfer material bearing member; and an urging means for urging the transfer material against said transfer material bearing member at an urging position; wherein the toner image on said image bearing member is transferred to said transfer material urged by said urging means and borne on said transfer material bearing member, and when the transfer material is pulled by a force equal to or greater than 10 Newtons along a transfer material conveying direction in a condition that the transfer material is urged against said transfer material bearing member by said urging means, the transfer material starts slipping with respect to said transfer material bearing member.

2. An image forming apparatus according to claim 1, wherein, when the transfer material urged by said urging means is pulled by a force equals to or smaller than 30 Newtons along the transfer material conveying direction, the transfer material starts slipping with respect to said transfer material bearing member.

3. An image forming apparatus according to claim 1, wherein said urging means includes a first urging member disposed at a side of a portion of said transfer material bearing member which bears the transfer material, and the transfer material is passed between said first urging member and said transfer material bearing member.

4. An image forming apparatus according to a claim 3, wherein said first urging member comprises a roller.

5. An image forming apparatus according to claim 4, wherein said roller is rotated by a conveying force of the transfer material when the transfer material is urged against said transfer material bearing member.

6. An image forming apparatus according to claim 3, wherein said urging means includes a second urging member opposed to said first urging member via said transfer material bearing member.

7. An image forming apparatus according to claim 6, wherein said second urging member comprises a roller.

8. An image forming apparatus according to claim 6, wherein said second urging member comprises a spring.

9. An image forming apparatus according to claim 3, wherein said transfer material bearing member comprises a belt, and a support roller for supporting said belt.

10. An image forming apparatus according to claim 9, wherein said support roller is opposed to said first urging member via said transfer material bearing member.

11. An image forming apparatus according to claim 1, further comprising a transfer means for electrostatically transferring the toner image on said image bearing member onto the transfer material urged against said transfer material bearing member by said urging means and borne on said transfer material bearing member.

12. An image forming apparatus according to claim 11, wherein the transfer material is electrostatically absorbed onto said transfer material bearing member by said transfer means.

13. An image forming apparatus according to claim 1, wherein a force for starting slippage of the transfer material with respect to said convey means by pulling the transfer material urged by said urging means along the transfer material conveying direction equals to or greater than a force for starting slippage of the transfer material with respect to said urging means by pulling the transfer material urged by said urging means along the transfer material conveying direction.

14. An image forming apparatus according to claim 13, wherein, while the transfer material is being conveyed by said convey means, a conveying force of said convey means for conveying the transfer material is not released.

15. An image forming apparatus according to claim 14, wherein said convey means comprises a pair of rollers.

16. An image forming apparatus according to claim 1, wherein a distance from said urging position to said transfer position along the transfer material conveying direction is smaller than a length of the transfer material in the transfer material conveying direction.

17. An image forming apparatus according to claim 1, wherein a basis weight of the transfer material is at least 200 $g/m^2$.

18. An image forming apparatus according to claim 1, wherein said transfer material bearing member comprises a substrate layer, and a dielectric layer provided on said substrate layer.

19. An image forming apparatus according to claim 18, further comprising an absorb charge means for electrostatically absorbing the transfer material urged by said urging means to said transfer material bearing member.

20. An image forming apparatus according to claim 1 or 18, wherein said image bearing member is capable of bearing a plural color toner images, and the plural color toner images on said image bearing member are successively transferred onto the transfer material urged against and born by said transfer material bearing member in a superimposed fashion.

21. An image forming apparatus according to claim 1, further comprising a plurality of image bearing members for bearing plural color toner images, respectively, wherein the plural color toner images on said plurality of image bearing members are successively transferred onto the transfer material urged against and borne by said transfer material bearing member in a superimposed fashion electrostatically.

22. An image forming apparatus according to claim 21, further comprising a plurality of transfer means for electrostatically transferring the plural color toner images on said plurality of image bearing members successively onto the transfer material urged against and born by said transfer material bearing member.

23. An image forming apparatus comprising:

a movable image bearing belt;

an image forming means for forming a toner image onto said image bearing belt at image forming position;

a transfer means for transferring the image on said image bearing belt to a transfer material; and a pressing means for pressing said image bearing belt.

24. An image forming apparatus according to claim 23 further comprising a cleaning means for clearing said image bearing belt at cleaning position when said transfer means completes to transfer the toner image from said image bearing belt to said transfer material.

25. An image forming apparatus according to claim 24, wherein said pressing means is disposed at a position downstream to said cleaning position but upstream to said image forming position in a moving direction of said image bearing belt.

26. An image forming apparatus according to claim 23, wherein said pressing means includes a first pressing member at one side of said image bearing belt on which the toner image is born.

27. An image forming apparatus according to claim 26, wherein said first pressing member is a roller.

28. An image forming apparatus according to claim 27, wherein a rotational driving force is transmitted to said roller from said image bearing belt.

29. An image forming apparatus according to claim 26, wherein said pressing means includes a second pressing member opposing to said first pressing member through said image bearing belt.

30. An image forming apparatus according to claim 29, wherein said second pressing member is a roller.

31. An image forming apparatus according to claim 29, wherein said second pressing member is a spring.

32. An image forming apparatus according to claim 26 further comprising a support roller for supporting said image bearing belt, said supporting roller opposing to said first pressing member through said image bearing belt.

33. An image forming apparatus according to claim 23, wherein said image forming apparatus is capable of producing toner images of a plurality of colors successively overlapping onto said image bearing belt and said toner image of plural colors is transferred to said transfer material by said transfer means.

34. An image forming apparatus according to any one of claims 23 to 33, wherein said image bearing member starts to move when said image bearing belt pressed by said pressing means is pulled by a force equal to or greater than 10 Newtons in the moving direction of said image bearing belt.

35. An image forming apparatus according to claim 34, wherein said image bearing member starts to move when said image bearing belt pressed by said pressing means is pulled by a force equal to or less than 30 Newtons in the moving direction of said image bearing belt.

* * * * *

UNITED STATES PATENT AND TRADEMARK OFFICE

CERTIFICATE OF CORRECTION

PATENT NO. : 6,097,922

DATED : August 1, 2000

INVENTOR(S): KATSUMI MUNENAKA

It is certified that error appears in the above-identified patent and that said Letters Patent is hereby corrected as shown below:

COVER PAGE AT ITEM [57] ABSTRACT:
Line 2, "comprises" should read --comprising--.

COLUMN 2:
Line 15, "floating" should read --float--;
Line 20, "the" should read --then--; and
Line 24, "hunting" should read --the hunting--.

COLUMN 3:
Line 57, "prevent" should read --to prevent--.

COLUMN 4:
Line 52, "influence" should read --influences--.

COLUMN 7:
Line 8, "an" (1st occurrence) should read --a--; and
Line 54, "adjected" should read --adjusted--.

COLUMN 8:
Line 58, "L" should read --where L--.

COLUMN 9:
Line 51, "regist" should read --register--.

COLUMN 11:
Line 29, "great stiffness due" should be deleted; and
Line 35, "regist" should read --register--.

UNITED STATES PATENT AND TRADEMARK OFFICE

CERTIFICATE OF CORRECTION

PATENT NO. : 6,097,922

DATED : August 1, 2000

INVENTOR(S): KATSUMI MUNENAKA

It is certified that error appears in the above-identified patent and that said Letters Patent is hereby corrected as shown below:

COLUMN 15:
Line 38, "equals" should read --equal--; and
Line 48, "a" should be deleted.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*